US011534789B2

(12) United States Patent
Takeda

(10) Patent No.: US 11,534,789 B2
(45) Date of Patent: Dec. 27, 2022

(54) METHOD FOR CLEANING PAINT SPRAY GUN

(71) Applicant: HONDA MOTOR CO., LTD., Tokyo (JP)

(72) Inventor: Kenichi Takeda, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 281 days.

(21) Appl. No.: 16/765,340

(22) PCT Filed: Feb. 7, 2019

(86) PCT No.: PCT/JP2019/004464
§ 371 (c)(1),
(2) Date: May 19, 2020

(87) PCT Pub. No.: WO2019/156178
PCT Pub. Date: Aug. 15, 2019

(65) Prior Publication Data

US 2020/0338583 A1 Oct. 29, 2020

(30) Foreign Application Priority Data

Feb. 7, 2018 (JP) ..... JP2018-019953

(51) Int. Cl.
*B05B 15/55* (2018.01)
*B05B 3/10* (2006.01)
(Continued)

(52) U.S. Cl.
CPC ..... *B05B 15/555* (2018.02); *B05B 3/1014* (2013.01); *B08B 3/028* (2013.01); *B08B 9/023* (2013.01); *B08B 9/032* (2013.01)

(58) Field of Classification Search
None
See application file for complete search history.

(56) References Cited

U.S. PATENT DOCUMENTS

2012/0291819 A1 11/2012 Wakimoto et al.
2017/0128969 A1 5/2017 Yamauchi

FOREIGN PATENT DOCUMENTS

CN 106457278 A 2/2017
JP S57-024662 A 2/1982
(Continued)

*Primary Examiner* — Eric W Golightly
*Assistant Examiner* — Arlyn I Rivera-Cordero
(74) *Attorney, Agent, or Firm* — Carrier Blackman & Associates, P.C.; Joseph P. Carrier; Fulchand P. Shende

(57) ABSTRACT

A method for cleaning a paint spray gun, which comprises a rotating atomization head to apply a coating material while rotating and an outer circumferential tube to cover the exterior of the rotating atomization head, has a cleaning solution application step for applying a cleaning solution to the external face of the outer circumferential tube, and a rotating atomization head rotation step for generating a rotational flow between the rotating atomization head and the outer circumferential tube by rotating the rotating atomization head. The cleaning solution flowing down the external face of the outer circumferential tube applied in the cleaning solution application step penetrates between the rotating atomization head and the outer circumferential tube by way of the rotational flow. Such method uses a small amount of cleaning solution for cleaning external and internal faces of the outer circumferential tube and the external face of a rotating atomization head.

17 Claims, 9 Drawing Sheets

(51) Int. Cl.

| | |
|---|---|
| ***B08B 3/02*** | (2006.01) |
| ***B08B 9/023*** | (2006.01) |
| ***B08B 9/032*** | (2006.01) |
| ***B05B 15/555*** | (2018.01) |

(56) References Cited

FOREIGN PATENT DOCUMENTS

| | | | |
|---|---|---|---|
| JP | S57-024673 | A | 2/1982 |
| JP | H09-192546 | A | 7/1997 |
| JP | 2003-245575 | A | 9/2003 |
| JP | 2006-334575 | A | 12/2006 |
| JP | 2011-230034 | A | 11/2011 |
| JP | 2017-047348 | A | 3/2017 |

METHOD FOR CLEANING PAINT SPRAY GUN

CROSS REFERENCE TO RELATED APPLICATIONS

The present application is the U.S. National Phase of PCT International Application PCT/JP2019/004464, filed Feb. 7, 2019, which, in turn, claimed priority based on Japanese patent application Japanese Patent Application No. 2018-019953, filed Feb. 7, 2018. The subject matter of each of these priority documents, including specification, claims, and drawings, is incorporated by reference herein.

TECHNICAL FIELD

The present invention relates to a method for cleaning a paint spray gun.

BACKGROUND ART

Conventionally, when an object to be painted such as a vehicle body is painted, a rotating atomization type paint spray gun is used in which painting is performed by spraying paint onto the object to be painted while rotating a rotating atomization head at a high speed (for example, see Patent Document 1).

The paint spray gun requires color change and cleaning each time the paint color of the object to be painted is changed. The above-mentioned conventional cleaning of the paint spray gun has been performed by spraying cleaning liquid on the paint spray gun from an oblique direction.

Patent Document 1: Japanese Unexamined Patent Application, Publication No. 2006-334575

DISCLOSURE OF THE INVENTION

Problems to be Solved by the Invention

Incidentally, there are paint spray guns in which an outer circumferential cylindrical body is provided so as to cover the external side of a rotating atomization head. When cleaning such a paint spray gun, it is necessary to clean not only the external face of an outer circumferential cylindrical body but also an internal face of the outer circumferential cylindrical body and an external face of a rotating atomization head covered by the outer circumferential cylindrical body with cleaning liquid. Especially in recent years, there has been a tendency to use a two-component paint composed of a base material and a curing agent or a water-based paint as a paint. Since these paints tend to remain on the external face of the rotating atomization head and the internal face of the outer circumferential cylindrical body, it is desired that the external face of the rotating atomization head and the internal face of the outer circumferential cylindrical body can be sufficiently cleaned when the paint spray gun is cleaned.

However, for the above-mentioned conventional method for cleaning the paint spray gun, since the cleaning liquid is sprayed on the paint spray gun from the oblique direction, the external face of the outer circumferential cylindrical body can be cleaned, but the internal face of the outer circumferential cylindrical body cannot be sufficiently cleaned. For the rotating atomization head, only the leading end part of the rotating atomization head that protrudes slightly from the outer circumferential cylindrical body can be cleaned.

To ensure that the external face of the rotating atomization head and the internal face of the outer circumferential cylindrical body can be cleaned sufficiently, it is conceivable to increase the number of cleaning nozzles and provide dedicated cleaning nozzles for spraying cleaning liquid between the rotating atomization head and the outer circumferential cylindrical body. However, in this instance, there is a problem that a cleaning device becomes complicated and large in size and the cost for cleaning increases. Further, it is conceivable to make a portion of cleaning liquid enter between the external face of the rotating atomization head and the internal face of the outer circumferential cylindrical body by increasing the ejection pressure of the cleaning liquid. However, in this instance, since cleaning liquid, which has vigorously collided with the paint spray gun, scatters peripherally, a large amount of cleaning liquid which does not contribute to cleaning is generated, and cleaning liquid is consumed unnecessarily. In addition, it is necessary to provide additional facilities for taking measures against scattering of cleaning liquid, cleaning of scattered cleaning liquid, and the like. Therefore, similarly to the above, there is a problem that the cleaning device becomes complicated and large in size and the cost for cleaning increases.

It is therefore an object of the present invention to provide a method for cleaning a paint spray gun which is capable of cleaning not only the external face of the outer circumferential cylindrical body but also the internal face of the outer circumferential cylindrical body and the external face of the rotating atomization head with less cleaning liquid, without complicating and enlarging the structure of the cleaning device.

Means for Solving the Problems (1) An aspect of the present invention provides a method for cleaning a paint spray gun (e.g., the paint spray gun 1 described later) including a rotating atomization head (e.g., the rotating atomization head 5 described later) that applies paint while rotating and an outer circumferential cylindrical body (e.g., the outer circumferential cylindrical body 7 described later) that covers an external side of the rotating atomization head. The method includes: a cleaning liquid application step of applying cleaning liquid (e.g., the cleaning liquid W described later) toward an external face (e.g., the external face 7*b* described later) of the outer circumferential cylindrical body of the paint spray gun; and a rotating atomization head rotation step of rotating the rotating atomization head to generate a swirling flow between the rotating atomization head and the outer circumferential cylindrical body. The swirling flow generated by the rotating atomization head rotation step makes the cleaning liquid (e.g., the pooled liquid W1 described later) applied by the cleaning liquid application step and having flowed down the external face of the outer circumferential cylindrical body enter between the rotating atomization head and the outer circumferential cylindrical body.

The above (1) enables the cleaning liquid applied to the external face of the outer circumferential cylindrical body to enter between the rotating atomization head and the outer circumferential cylindrical body, so that not only the external face of the outer circumferential cylindrical body but also an internal face of the outer circumferential cylindrical body and an external face of the rotating atomization head can be cleaned without complicating and enlarging the structure of the cleaning device. Since cleaning liquid can be applied in an appropriate amount and at a low pressure, the paint spray gun can be cleaned with a minimum amount of cleaning liquid. Thus, this cleaning method allows cleaning liquid and cleaning waste liquid to be reduced and environmentally friendly and low-cost cleaning to be achieved. Further, the cleaning device only needs to have the functions of applying cleaning liquid and recovering cleaning waste liquid, and can have a compact and simple configuration. This enables the space in which the cleaning device is provided and the cost of the cleaning device to be reduced. Moreover, since this cleaning method enables a desired area of the paint spray gun to be cleaned and water droplets adhering to the paint spray gun to be removed (dried), there is no need to separately provide a drying device for drying the paint spray gun, and further miniaturization and cost reduction of the cleaning device can be achieved.

(2) In the method for cleaning a paint spray gun according to (1), the paint spray gun preferably includes a plurality of fluid ejection holes (e.g., the fluid ejection holes 73 described later) that ejects fluid, provided in a leading end face (e.g., the leading end face 72 described later) of the outer circumferential cylindrical body in a circumferential direction. The method preferably further includes a fluid ejection step of ejecting the fluid from the fluid ejection holes. Airflow of the fluid ejected by the fluid ejection step and the swirling flow generated by the rotating atomization head rotation step preferably make the cleaning liquid applied by the cleaning liquid application step and having flowed down the external face of the outer circumferential cylindrical body enter between the rotating atomization head and the outer circumferential cylindrical body through the leading end face of the outer circumferential cylindrical body.

According to the above (2), the cleaning liquid that has flowed down the external face of the outer circumferential cylindrical body can be moved quickly from the outer circumferential side of the leading end face of the outer circumferential cylindrical body to the inner circumferential side thereof by the fluid ejected from the fluid ejection hole, and the leading end face of the outer circumferential cylindrical body can be cleaned.

(3) In the method for cleaning a paint spray gun according to (2), the fluid ejection holes preferably include a plurality of first fluid ejection holes (e.g., the first fluid ejection holes 731 described later) disposed on an inner side, in a radial direction of an axis, of the outer circumferential cylindrical body; and a plurality of second fluid ejection holes (e.g., the second fluid ejection holes 732 described later) disposed on an outer side, in the radial direction of the axis, of the outer circumferential cylindrical body.

According to the above (3), the airflow of fluid ejected from the first fluid ejection hole and the airflow of fluid ejected from the second fluid ejection hole can make the cleaning liquid that has flowed down to the leading end face of the outer circumferential cylindrical body efficiently enter between the external side of the rotating atomization head and the internal side of the outer circumferential cylindrical body.

(4) In the method for cleaning a paint spray gun according to (3), the first fluid ejection hole preferably ejects fluid (e.g., the air A1 described later) downwardly with respect to an axial direction, and the second fluid ejection hole preferably ejects fluid (e.g., the air A2 described later) inwardly with respect to the radial direction of the axis.

According to the above (4), the cleaning liquid that has flowed down to the leading end face of the outer circumferential cylindrical body can be drawn inwardly with respect to the radial direction of the axis by the airflow of the fluid ejected from the second fluid ejection hole disposed on the outer side, and subsequently can be drawn further inwardly with respect to the radial direction of the axis by the airflow of the fluid ejected from the first fluid ejection hole disposed on the inner side. Thus, it is possible to effectively make the cleaning liquid enter between the external side of the rotating atomization head and the internal side of the outer circumferential cylindrical body.

(5) In the method for cleaning a paint spray gun according to any one of (2) to (4), the fluid ejection hole preferably ejects fluid for regulating an area to which paint is applied during normal painting.

According to the above (5), there is no need to separately provide fluid ejection holes for ejecting air for cleaning in the paint spray gun, and an additional cost for cleaning is not generated.

(6) In the method for cleaning a paint spray gun according to any one of (2) to (5), an ejection pressure of the fluid ejected from the fluid ejection hole is preferably smaller than an ejection pressure of fluid ejected from the fluid ejection hole during normal painting.

The above (6) prevents the cleaning liquid from scattering due to the pressure of the fluid ejected from the fluid ejection hole, and consumption of wasteful cleaning liquid can be further suppressed.

(7) In the method for cleaning a paint spray gun according to any one of (1) to (6), a rotation number of the rotating atomization head is preferably lower than a rotation number of the rotating atomization head during normal painting.

According to the above (7), the swirling flow formed between the external side of the rotating atomization head and the internal side of the outer circumferential cylindrical body can be made weaker than a swirling flow formed during normal painting. Thus, it is possible to avoid a risk that the cleaning liquid adheres to the bottom of the recess of the outer circumferential cylindrical body and the cleaning liquid unexpectedly falls due to vibrations or the like during the next painting to contaminate the painted surface.

Effects of the Invention

According to the present invention, it is possible to provide the method for cleaning a paint spray gun which is capable of cleaning not only the external face of the outer circumferential cylindrical body but also the internal face of the outer circumferential cylindrical body and the external face of the rotating atomization head with less cleaning liquid, without complicating and enlarging the structure of the cleaning device.

PREFERRED MODE FOR CARRYING OUT THE INVENTION

Figure 1:
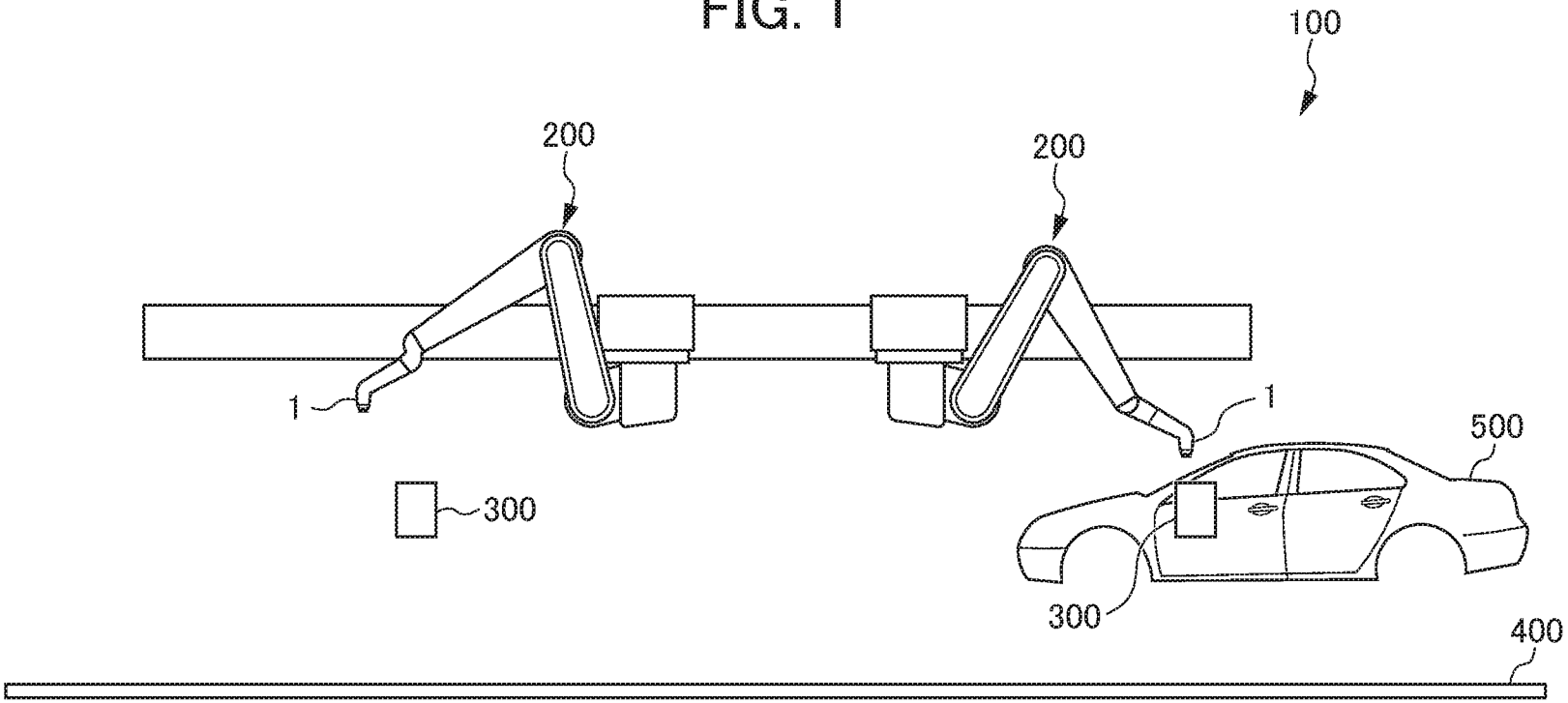
FIG. 1 is a diagram showing a schematic configuration of an embodiment of a painting apparatus including a cleaning device.

Hereinafter, an embodiment of the present invention will be described in detail with reference to the drawings. FIG. 1 is a diagram showing a schematic configuration of an embodiment of a painting apparatus including a cleaning device. A painting apparatus 100 includes a plurality of painting robots 200 having a paint spray gun 1 at their leading ends, and a plurality of cleaning devices 300 provided corresponding to the painting robots 200.

The painting apparatus 100 is configured to paint a vehicle body 500 by applying paint from the paint spray guns 1 of the plurality of the painting robots 200 to the vehicle body 500 conveyed on a conveyance line 400 with a conveyance unit (not shown).

The cleaning device 300 is configured so that the paint spray gun 1 can be inserted therein, and is provided to be raised and lowered by a lifting device (not shown). The cleaning device 300 is raised to a predetermined position by the lifting device when cleaning the paint spray gun 1 described later and houses the paint spray gun 1 which is lowered by the operation of the painting robot 200 in the interior, and subsequently, cleans the paint spray gun 1 by applying cleaning liquid in accordance with a predetermined program.

Figure 2:
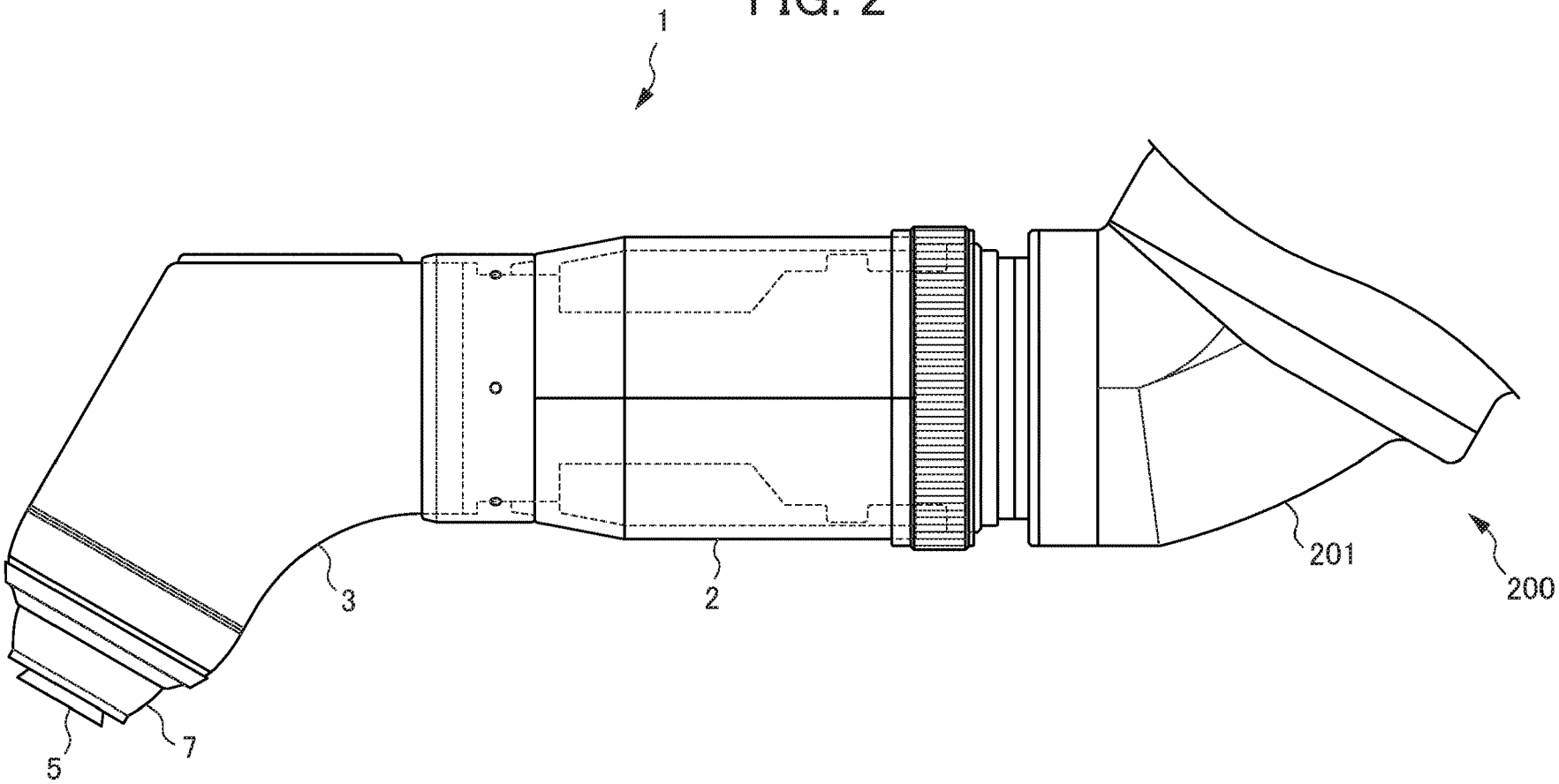
FIG. 2 is a side view showing an embodiment of a paint spray gun in the present invention.
Figure 3:
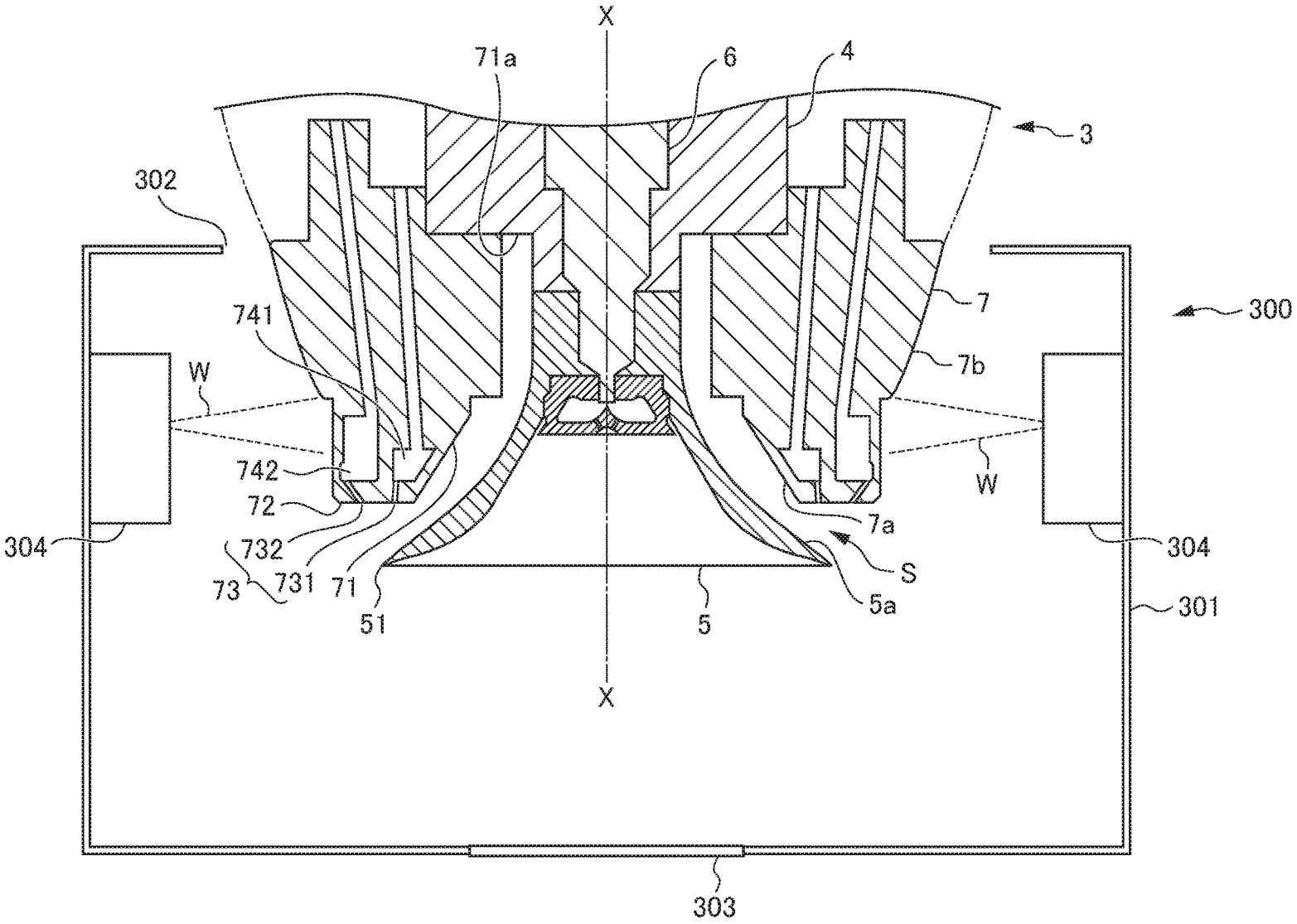
FIG. 3 is a cross-sectional view showing an appearance during cleaning of the paint spray gun shown in FIG. 2.
Figure 4:
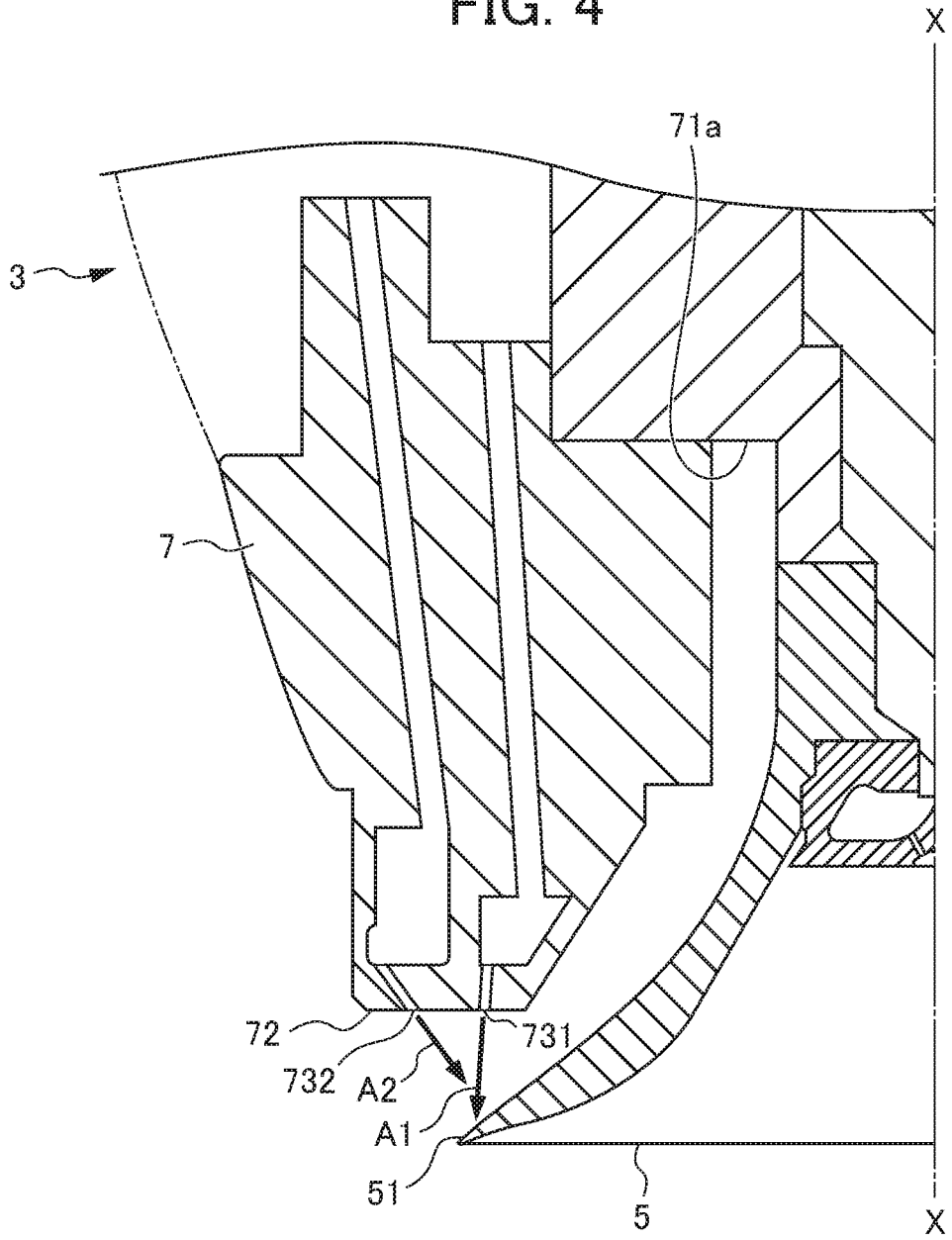
FIG. 4 is a cross-sectional view of a main part of the paint spray gun shown in FIG. 2.
Figure 5:
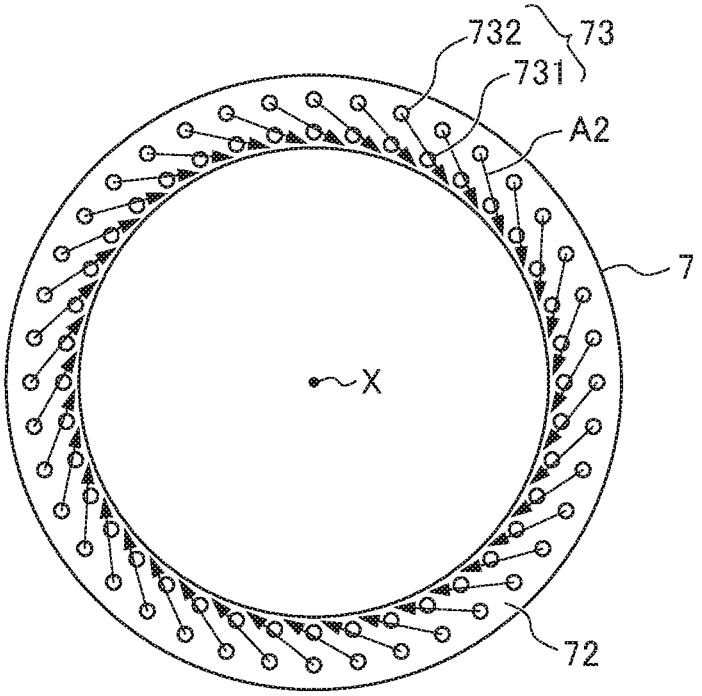
FIG. 5 is a bottom view showing the ejection direction of fluid from the leading end portion of an outer circumferential cylindrical body of the paint spray gun.

Next, the configuration of the paint spray gun 1 will be described with reference to FIGS. 2 to 5. FIG. 2 is a side view showing an embodiment of the paint spray gun 1 in the present invention. FIG. 3 is a cross-sectional view showing an appearance during cleaning of the paint spray gun 1 shown in FIG. 2. FIG. 4 is a cross-sectional view of a main part of the paint spray gun 1 shown in FIG. 2. FIG. 5 is a bottom view showing the ejection direction of fluid from the leading end portion of an outer circumferential cylindrical body of the paint spray gun 1.

As shown in FIG. 2, the paint spray gun 1 includes a cylindrical body portion 2 attached to the leading end of a robot arm 201 of the painting robot 200, and a head portion 3 having a substantially dog-leg shape in which the leading end part is bent. The head portion 3 is detachably provided at the leading end of the body portion 2.

As shown in FIG. 3, the head portion 3 of the paint spray gun 1 includes an air motor 4, a rotating atomization head 5 which is rotatably driven by the air motor 4, a feed pipe 6 that feeds paint to the rotating atomization head 5, and an outer circumferential cylindrical body 7 that covers the external side of the rotating atomization head 5. It should be noted that in FIG. 3, the air motor 4 and the feed pipe 6 are simplified.

The rotating atomization head 5 has a substantially conical shape in which the inner diameter increases toward the leading end side, and is provided at the leading end of the head portion 3 so as to be rotatable about a rotation axis X by the air motor 4. The rotating atomization head 5 is formed so as to surround the leading end of the feed pipe 6 and to openly expand toward the direction in which the paint is sprayed (downward direction in FIGS. 3 and 4).

The outer circumferential cylindrical body 7 has a substantially cylindrical shape surrounding the external side of the rotating atomization head 5, and is provided at the leading end of the head portion 3. In the center of the outer circumferential cylindrical body 7, a substantially conical recess 71 is provided concentrically with the rotation axis X. Most of the rotating atomization head 5 is housed in this recess 71. A predetermined gap S is formed between an internal face 7*a* of the outer circumferential cylindrical body 7 (the inner face of the recess 71) and an external face 5*a* of the rotating atomization head 5.

A leading end face 72 of the outer circumferential cylindrical body 7 is formed to be an annular flat face and surrounds the circumference of the recess 71. A plurality of fluid ejection holes 73 are formed in a circumferential direction of a circle around the rotation axis X at equal intervals on the leading end face 72. In the present embodiment, the fluid ejection holes 73 are composed of first fluid ejection holes 731 and second fluid ejection holes 732 arranged on two concentric circles about the axis (rotation axis X) as shown in FIG. 5. A plurality of the first fluid ejection holes 731 is disposed in the inner circle (inner side, in a radial direction of the axis) of the two concentric circles at equal intervals in a circumferential direction. A plurality of the second fluid ejection holes 732 is disposed in the outer circle (outer side, in the radial direction of the axis) of the two concentric circles at equal intervals in a circumferential direction.

Inside the outer circumferential cylindrical body 7, an annular first fluid path 741 communicating with the plurality of the first fluid ejection holes 731 and an annular second fluid path 742 communicating with the plurality of the second fluid ejection holes 732 are provided. Each of the first fluid path 741 and the second fluid path 742 is a flow path through which fluid supplied from a fluid supply source (not shown) flows. In the present embodiment, air is used as the fluid.

Air, which flows through the first fluid path 741 and the second fluid path 742, is respectively ejected as shaping air from the plurality of the first fluid ejection holes 731 and the second fluid ejection holes 732 at the time of normal painting. The shaping air ejected from the first fluid ejection hole 731 and the second fluid ejection hole 732 collides with paint (two-component paint or water-based paint) sprayed by the centrifugal force of the rotating atomization head 5 that rotates at a high speed, promotes the miniaturization of the paint, directs the spraying direction of the paint to the center, and thereby regulates an area to which paint is applied. In the present embodiment, the ejection pressure (ejection amount per unit time) of the shaping air ejected respectively from the first fluid ejection hole 731 and the second fluid ejection hole 732 is independently adjustable.

Here, as shown in FIG. 4, a leading end portion 51 of the rotating atomization head 5 protrudes downwardly in an axial direction (the direction along the rotation axis X) compared to the leading end face 72 of the outer circumferential cylindrical body 7, and further, slightly overlaps with the inner circumferential side of the leading end face 72 of the outer circumferential cylindrical body 7. The first fluid ejection hole 731 is disposed at a position where the leading end face 72 of the outer circumferential cylindrical body 7 and the leading end portion 51 of the rotating atomization head 5 overlap with each other. As indicated by an arrow in FIG. 4, the first fluid ejection hole 731 is formed so as to eject shaping air A1 toward the leading end portion 51 of the rotating atomization head 5 and downwardly with respect to the axial direction and slightly outwardly with respect to the radial direction of the axis. Thus, the shaping air A1 ejected from the first fluid ejection hole 731 collides with the leading end portion 51 of the rotating atomization head 5.

On the other hand, the second fluid ejection hole 732 is disposed on the outer circumferential side of the leading end face 72 of the outer circumferential cylindrical body 7 which is not overlapped with the leading end portion 51 of the rotating atomization head 5. As indicated by an arrow in FIG. 4, the second fluid ejection hole 732 is formed so as to eject shaping air A2 toward the leading end portion 51 of the rotating atomization head 5 and inwardly with respect to the radial direction of the axis. Thus, the shaping air A2 ejected from the second fluid ejection hole 732 collides with the leading end portion 51 of the rotating atomization head 5, similarly to the shaping air A1 ejected from the first fluid ejection hole 731.

Incidentally, as shown in FIG. 5, the ejection direction of the shaping air A2 from each of the second fluid ejection holes 732 is slightly inclined in the same direction along the circumferential direction of a circle around the rotation axis X (forward direction with respect to the rotation direction of the rotating atomization head 5).

Next, the configuration of the cleaning device 300 will be described with reference to FIG. 3. The cleaning device 300 includes a box-shaped recovery hopper 301. The recovery hopper 301 includes an opening 302, into which the head portion 3 of the paint spray gun 1 can be inserted, at its upper end portion and a recovery port 303, which suctions and recovers cleaning waste liquid discharged by cleaning, at its lower end portion.

Inside the recovery hopper 301, a plurality of cleaning nozzles 304 is provided. The plurality of the cleaning nozzles 304 is provided so as to be arranged around the outer circumferential cylindrical body 7 of the paint spray gun 1 inserted through the opening 302 so that cleaning liquid can be applied to the entire external face 7*b* of the outer circumferential cylindrical body 7. For example, four cleaning nozzles 304 are provided so as to be spaced at an angle of 90 degrees around the outer circumferential cylindrical body 7 of the paint spray gun 1. The number of the cleaning nozzles 304 is not limited and may be at least one.

The cleaning nozzles 304 apply cleaning liquid supplied from a cleaning liquid supplying device (not shown) toward the external face 7*b* of the outer circumferential cylindrical body 7 of the paint spray gun 1. As the cleaning liquid, for example, water containing a solvent such as ethanol is used. The cleaning nozzles 304 can also apply pure water for cleaning the inside of the recovery hopper 301.

Figure 6:
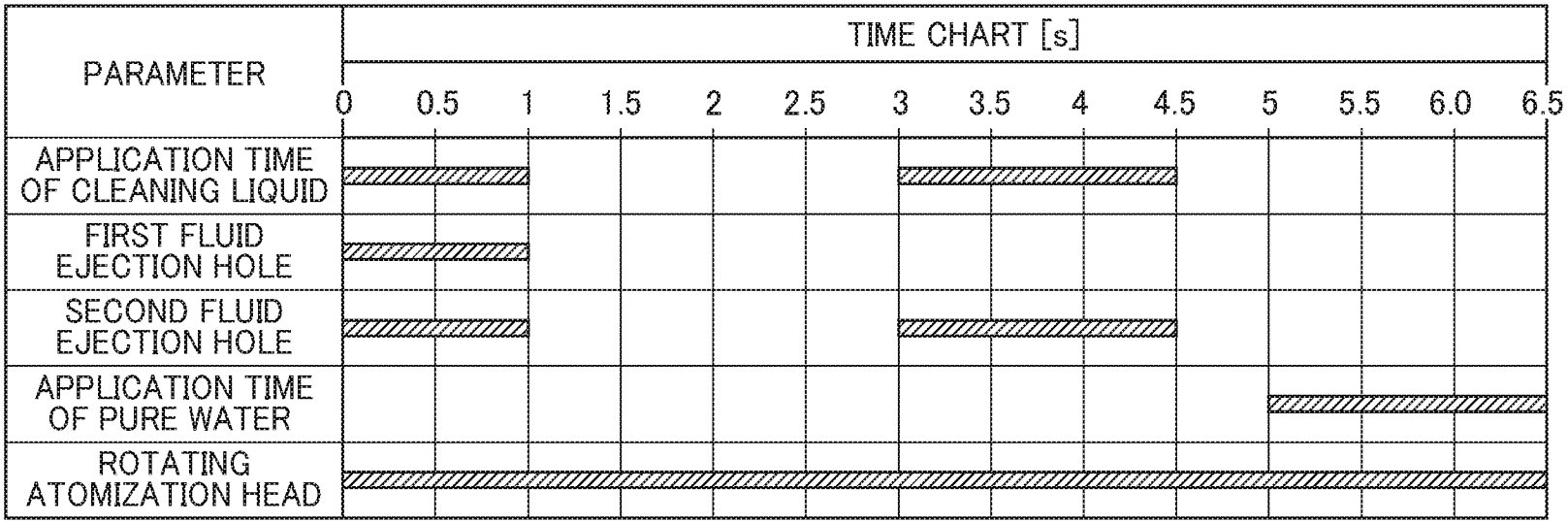
FIG. 6 is a time chart showing an embodiment of the cleaning operation of a paint spray gun in the present invention.

Next, a method for cleaning the paint spray gun 1 will be described with reference to FIGS. 6 to 13. FIG. 6 is a time chart showing an embodiment of the cleaning operation of the paint spray gun 1 in the present invention. FIGS. 7 to 13 are diagrams for explaining the cleaning mechanism of the paint spray gun 1 in the present invention. FIGS. 7 to 13, which explain the inside of the outer circumferential cylindrical body 7, schematically show a simplified rotating atomization head 5 and outer circumferential cylindrical body 7 in order to facilitate understanding of the present invention.

First, at the time of cleaning the paint spray gun 1, the cleaning device 300 is raised to a predetermined height by a lifting device (not shown) to be on standby. The painting robot 200 puts the head portion 3 of the paint spray gun 1 into the opening 302 of the recovery hopper 301 downwardly in the axial direction, and stops it at a predetermined height in the recovery hopper 301. In the present embodiment, to enable the paint spray gun 1 to move quickly to the next painting at the time of cleaning, the rotating atomization head 5 is driven to rotate at a constant rotation number by the air motor 4 while feeding of paint is stopped (rotating atomization head rotation step).

Figure 7:
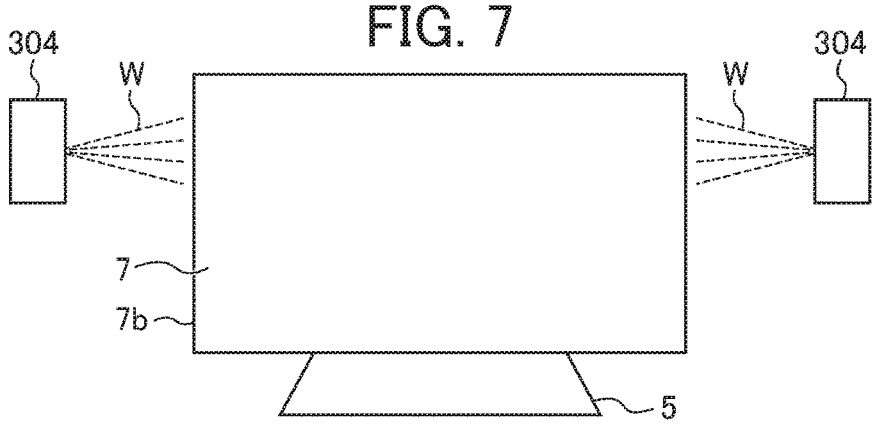
FIG. 7 is a diagram illustrating the cleaning mechanism of the paint spray gun in the present invention.

As shown in FIG. 7, when cleaning is started, cleaning liquid W is applied from each of the cleaning nozzles 304 toward the external face 7*b* of the outer circumferential cylindrical body 7 (cleaning liquid application step). The paint spray gun 1 ejects air from the first fluid ejection hole 731 and the second fluid ejection hole 732 at the same time as the start of the application of the cleaning liquid W (fluid ejection step).

The cleaning liquid W is applied in an appropriate amount and at an appropriate application pressure so as not to vigorously collide with the external face 7*b* of the outer circumferential cylindrical body 7 and scatter. In the present embodiment, the cleaning liquid W is applied for only one second from the respective cleaning nozzles 304. Further, the air is ejected from the first fluid ejection hole 731 and the second fluid ejection hole 732, respectively for one second which is the same as the application time of the cleaning liquid W.

Figure 8:
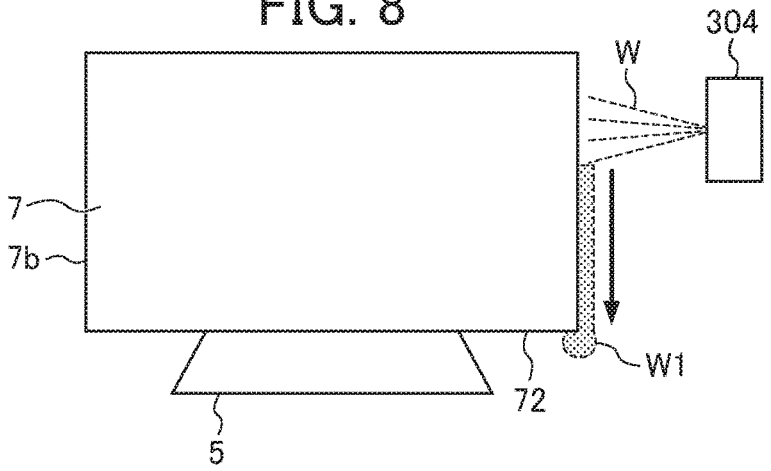
FIG. 8 is a diagram illustrating the cleaning mechanism of the paint spray gun in the present invention.
Figure 9:
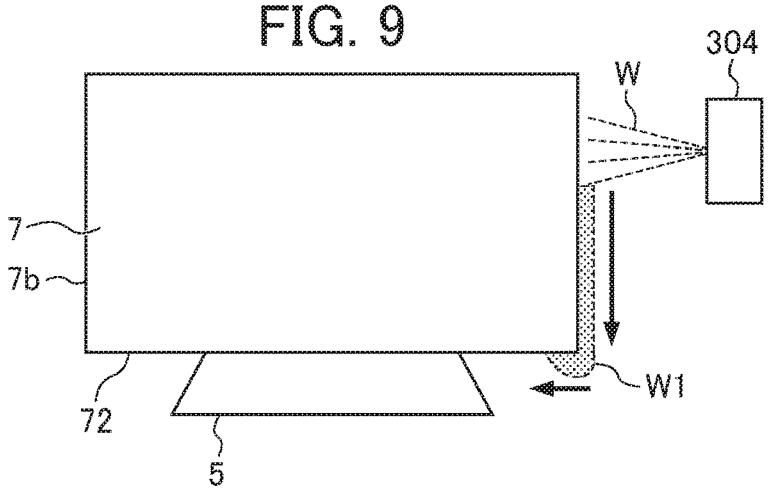
FIG. 9 is a diagram illustrating the cleaning mechanism of the paint spray gun in the present invention.

As shown in FIG. 8, the cleaning liquid W applied to the external face 7*b* of the outer circumferential cylindrical body 7 flows down the external face 7*b* under its own weight. The cleaning liquid W cleans the external face 7*b* in the course of this flow. The cleaning liquid W that has flowed down the external face 7*b* pools into a pooled liquid W1 on the outer circumferential side of the leading end face 72 of the outer circumferential cylindrical body 7. The pooled liquid W1 is sucked into airflow caused by the air ejected from the first fluid ejection hole 731 and the second fluid ejection hole 732, and moves along the leading end face 72 of the outer circumferential cylindrical body 7 inwardly (rotating atomization head 5 side).

Figure 10:
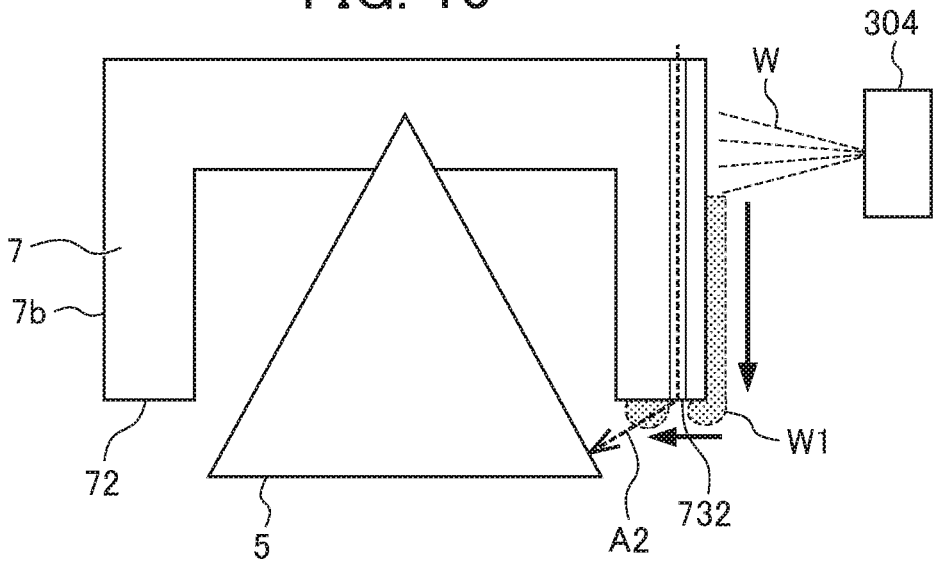
FIG. 10 is a diagram illustrating the cleaning mechanism of the paint spray gun in the present invention.

More particularly, as shown in FIG. 10, since the second fluid ejection hole 732 on the outer circumferential side ejects the air A2 inwardly with respect to the radial direction of the axis, inward airflow is generated around the second fluid ejection hole 732. The pooled liquid W1 is sucked into the inward airflow and thereby moves along the leading end face 72 of the outer circumferential cylindrical body 7 inwardly.

Figure 11:
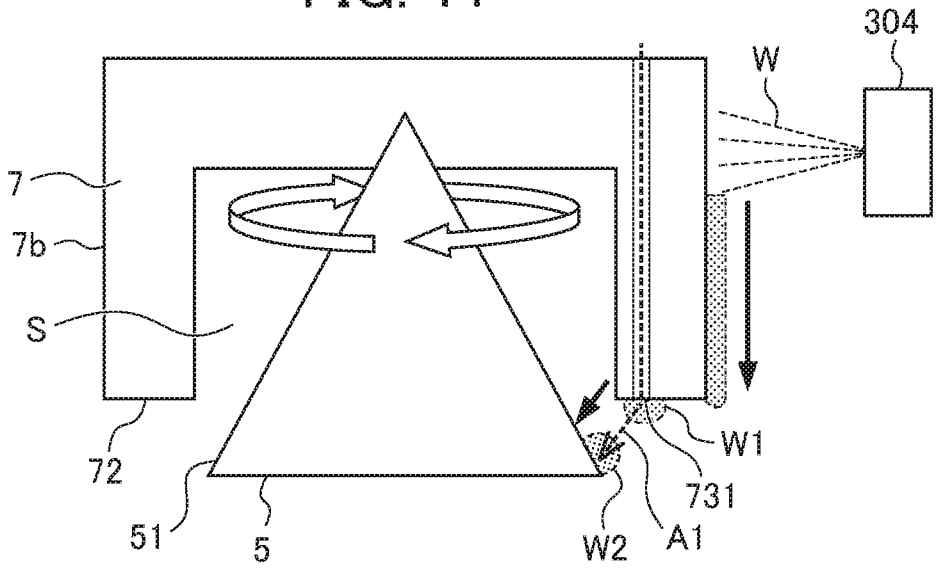
FIG. 11 is a diagram illustrating the cleaning mechanism of the paint spray gun in the present invention.

As shown in FIG. 11, the pooled liquid W1 moved inwardly is further sucked into airflow caused by the air A1 ejected from the first fluid ejection hole 731. As a result, the pooled liquid W1 is drawn further inwardly and reaches the inner circumferential side of the leading end face 72. That is, the air A1 and air A2 are ejected from the first fluid ejection hole 731 and the second fluid ejection hole 732, which enables the pooled liquid W1 to quickly move from the outer circumferential side of the leading end face 72 composed of an annular flat face to the inner circumferential side thereof. The pooled liquid W1 cleans the leading end face 72 in the process of moving along the leading end face 72 from the outer circumferential side to the inner circumferential side.

Here, in the present embodiment, the ejection pressure of the air A1 ejected from the first fluid ejection hole 731 is set to be larger than the ejection pressure of the air A2 ejected from the second fluid ejection hole 732. Since the pooled liquid W1 is drawn toward stronger airflow, the pooled liquid W1 on the leading end face 72 of the outer circumferential cylindrical body 7 can be moved quickly toward the inner circumferential side by increasing the ejection pressure of the air A1 ejected from the first fluid ejection hole 731 than that of the air A2 ejected from the second fluid ejection hole 732.

A specific air ejection pressure (ejection amount per unit time) is not limited, but in the present embodiment, the air ejection pressure of the first fluid ejection hole 731 is set to 80 nl/min, and the air ejection pressure of the second fluid ejection hole 732 is set to 50 nl/min. The values of these ejection pressures are set to be smaller than those of the ejection pressures of fluid to be ejected from the first fluid ejection hole 731 and the second fluid ejection hole 732 during normal painting. As a result, it is possible to prevent the cleaning liquid from scattering by the pressures of the fluid ejected from the first fluid ejection hole 731 and the second fluid ejection hole 732 and to suppress the consumption of wasteful cleaning liquid.

The pooled liquid W1, which is further drawn to the inner circumferential side of the leading end face 72 by the airflow of the air A1 ejected from the first fluid ejection hole 731, is drawn away from the leading end face 72 by the air A1 and becomes cleaning liquid droplets W2. Subsequently, the cleaning liquid droplets W2 are blown toward the leading end portion 51 of the rotating atomization head 5.

In the gap S between the external side of the rotating atomization head 5 and the internal side of the outer circumferential cylindrical body 7, a swirling flow (swirling upflow) is generated to swirl along the external face 5*a* of the rotating atomization head 5 by rotation of the rotating atomization head 5. The cleaning liquid droplets W2 blown off to the leading end portion 51 of the rotating atomization head 5 are caught in the swirling flow to enter the gap S.

Incidentally, the amount of the cleaning liquid to enter the gap S between the external side of the rotating atomization head 5 and the internal side of the outer circumferential cylindrical body 7 is adjusted by the balance of the ejection pressure of the air A1 ejected from the first fluid ejection hole 731 and that of the air A2 ejected from the second fluid ejection hole 732. Therefore, it is preferable to adjust as appropriate the balance between the ejection pressure of the air A1 ejected from the first fluid ejection hole 731 and that of the air A2 ejected from the second fluid ejection hole 732 depending on the size of the gap S, the degree of contamination, or the like.

Figure 12:
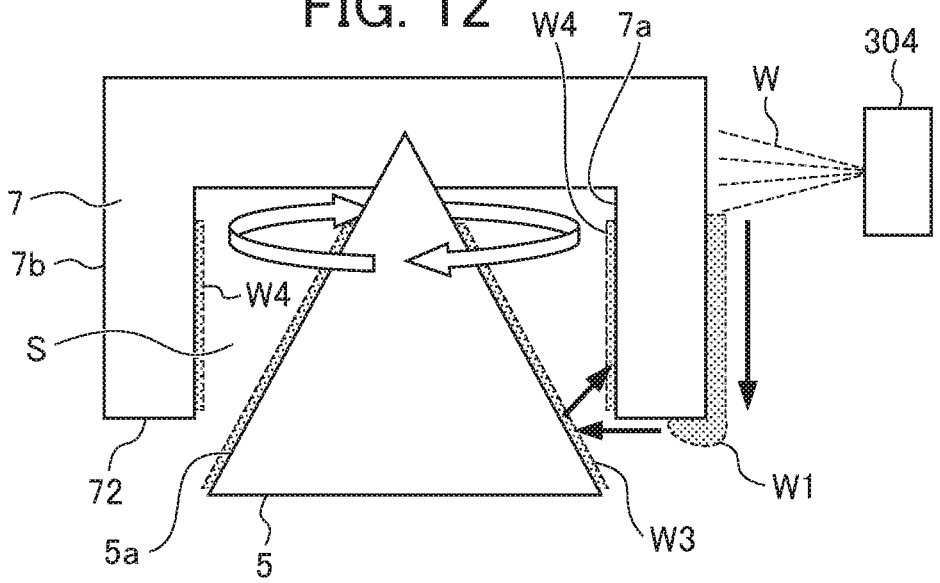
FIG. 12 is a diagram illustrating the cleaning mechanism of the paint spray gun in the present invention.

As shown in FIG. 12, the cleaning liquid droplets W2 that has entered the gap S form a liquid film W3 along the external face 5*a* of the rotating atomization head 5 that rotates. Further, a portion of the cleaning liquid droplets W2 is repelled when it collides with the rotating atomization head 5 that rotates and adheres to the internal face 7*a* of the outer circumferential cylindrical body 7. The cleaning liquid droplets W2 that has adhered to the internal face 7*a* form a liquid film W4 by a swirling flow.

Figure 13:
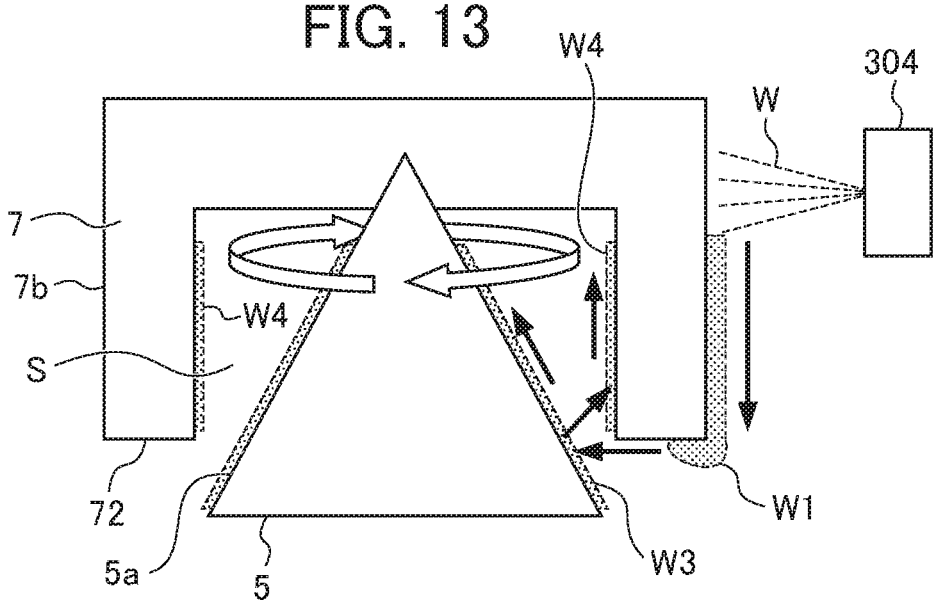
FIG. 13 is a diagram illustrating the cleaning mechanism of the paint spray gun in the present invention.

Thereafter, as shown in FIG. 13, further cleaning liquid droplets W2 collide with the liquid film W3 on the external face 5*a* of the rotating atomization head 5, and a further liquid film W3 is further formed on the external face 5*a* of the rotating atomization head 5, and a portion of the cleaning liquid droplets W2 that have collided with the liquid film W3 is repelled to adhere to the internal face 7*a* of the outer circumferential cylindrical body 7, and a further liquid film W4 is formed on the internal face 7*a*. These liquid films W3 and W4 are raised while swirling respectively along the external face 5*a* of the rotating atomization head 5 and the internal face 7*a* of the outer circumferential cylindrical body 7 by a swirling flow to clean these external face 5*a* and internal face 7*a*.

The swirling flow is formed so as to cause vortex-collapse, near the upper portion of the gap S, specifically at a position below a bottom 71*a* of the recess 71 by adjusting as appropriate the rotation number (rotation speed) of the rotating atomization head 5. The rise of the liquid films W3 and W4 stops at a height at which vortex-collapse of a swirling flow is caused, and the liquid amounts of the liquid films W3 and W4 are increased by newly rising cleaning liquid. When its own weight of cleaning liquid forming the liquid films W3 and W4 exceeds the rising force by a swirling flow, the cleaning liquid flows down under its own weight together with paint, and falls into the recovery hopper 301 together with cleaned paint.

Further, vortex-collapse of the swirling flow is caused at a position below the bottom 71*a* of the recess 71 by adjusting the rotation number of the rotating atomization head 5. Thus, it is possible to avoid the risk that the cleaning liquid adheres to the bottom 71*a* of the recess 71 of the outer circumferential cylindrical body 7 and the cleaning liquid unexpectedly falls due to vibrations or the like during the next painting to contaminate the painted surface. In other words, since the rotation number of the rotating atomization head 5 affects the strength of the swirling flow, the higher the rotation number is, the stronger the swirling flow generates. Accordingly, the position of vortex-collapse becomes higher. If the position of the vortex-collapse becomes higher, the cleaning liquid may reach the bottom 71*a* of the recess 71 of the outer circumferential cylindrical body 7, and thus, the cleaning liquid may adhere to the bottom 71*a* of the recess 71. Since it is difficult for the cleaning liquid that has adhered to the bottom 71*a* of the recess 71 to fall under its own weight, it may unexpectedly fall due to vibrations or the like at the time of the next painting to contaminate the painted surface. By adjusting as appropriate the rotation number of the rotating atomization head 5 during cleaning of the paint spray gun 1, it is possible to lower the position of vortex-collapse of the swirling flow, and thus, such a problem can be avoided.

Thus, the rotation number of the rotating atomization head 5 forming a swirling flow in which vortex-collapse is caused at a position below the bottom 71*a* of the recess 71 during cleaning is set to be lower than the rotation number of the rotating atomization head 5 during normal painting. A specific rotation number of the rotating atomization head 5 during cleaning is not particularly limited, but may be adjusted in the range of 25,000 rpm to 40,000 rpm, for example.

In the present embodiment, as shown in FIG. 6, the above-described cleaning is performed by applying cleaning liquid for one second and ejecting air for one second. Thereafter, a two second pause period is provided to pause the application of the cleaning liquid and the ejection of the air. After the pause period, a second application of the cleaning liquid and ejection of the air are performed for 1.5 seconds. This pause period allows the cleaning liquid to penetrate into paint still remaining on the external face 5*a* of the rotating atomization head 5 and on the internal face 7*a* of the outer circumferential cylindrical body 7. The paint, into which the cleaning liquid has penetrated, swells and softens, and is easily separated from the external face 5*a* of the rotating atomization head 5 and the internal face 7*a* of the outer circumferential cylindrical body 7. The second application of the cleaning liquid and ejection of the air cause new cleaning liquid to enter the gap S between the external face 5*a* of the rotating atomization head 5 and the internal face 7*a* of the outer circumferential cylindrical body 7, whereby the swelled and softened paint is easily removed from the external face 5*a* and the internal face 7*a* and falls into the recovery hopper 301 together with the cleaning liquid.

In the second application of the cleaning liquid and ejection of the air, the remaining paint is softened and easily separated, so that a large amount of cleaning liquid does not need to enter the gap S. Therefore, in the present embodiment, the amount of cleaning liquid to enter the gap S is adjusted by pausing the ejection of air from the first fluid ejection hole 731 and ejecting air at an ejection amount of 200 nl/min only from the second fluid ejection hole 732.

Pure water is applied from the respective cleaning nozzles 304 0.5 seconds after the second application of the cleaning liquid and ejection of the air are completed. This cleans the external face 7*b* of the outer circumferential cylindrical body 7 and flushes out cleaning liquid components remaining primarily on the external face 7*b* of the outer circumferential cylindrical body 7. When the cleaning of the paint spray gun 1 is finished, the paint spray gun 1 is raised and is taken out from the cleaning device 300, and the cleaning device 300 is lowered.

As described above, this cleaning method utilizes the rotation of the rotating atomization head 5 and the ejection of air from the first fluid ejection hole 731 and the second fluid ejection hole 732 to make the cleaning liquid applied to the external face 7*b* of the outer circumferential cylindrical body 7 enter the gap S between the external side of the rotating atomization head 5 and the internal side of the outer circumferential cylindrical body 7 through the leading end face 72 of the outer circumferential cylindrical body 7. This enables the external face 7*b*, internal face 7*a*, and leading end face 72 of the outer circumferential cylindrical body 7 and the external face 5*a* of the rotating atomization head 5 to be cleaned without the need to newly add a dedicated cleaning nozzle for cleaning the external face 5*a* of the rotating atomization head 5 and the internal face 7*a* of the outer circumferential cylindrical body 7. Therefore, the external face 5*a* of the rotating atomization head 5 and the external face 7*b*, internal face 7*a*, and leading end face 72 of the outer circumferential cylindrical body 7 can be sufficiently cleaned without complicating and enlarging the structure of the cleaning device 300.

Since cleaning liquid can be applied in an appropriate amount and at a low pressure, the paint spray gun 1 can be cleaned with a minimum amount of cleaning liquid. Thus, the amount of cleaning liquid and cleaning waste liquid can be reduced, and environmentally friendly and low-cost cleaning can be achieved.

Further, the cleaning device 300 only needs to have the functions of normally applying cleaning liquid and recovering cleaning waste liquid, and thus can have a compact and simple configuration. Therefore, the space in which the cleaning device 300 is provided and the cost of the cleaning device 300 can also be reduced. In addition, according to this cleaning method, since a desired area of the paint spray gun 1 can be cleaned and water droplets adhering to the paint spray gun 1 can be removed (dried), there is no need to separately provide a drying apparatus for drying the paint spray gun 1, and further miniaturization and cost reduction of the cleaning device 300 can be achieved.

In addition, after the paint spray gun 1 is separated from the cleaning device 300, the cleaning device 300 may clean the interior of the recovery hopper 301 by spraying pure water from the cleaning nozzles 304 toward the interior of the recovery hopper 301 for a predetermined period of time. The cleaning waste liquid accumulated in the recovery hopper 301 is sucked and recovered from the recovery port 303.

The interior cleaning operation of the recovery hopper 301 can be performed even prior to the paint spray gun 1 being put into the recovery hopper 301. Since a liquid film is formed on the inner face of the recovery hopper 301 by applying pure water in the recovery hopper 301 prior to cleaning of the paint spray gun 1, it is possible to suppress adherence of dirt in the recovery hopper 301.

Incidentally, in the present embodiment, the paint spray gun 1 includes two types of fluid ejection holes that eject fluid for cleaning, that is, the first fluid ejection hole 731 disposed on an inner side, in the radial direction of the axis and the second fluid ejection hole 732 disposed on an outer side, in the radial direction of the axis. This enables the cleaning liquid that has flowed down to the leading end face 72 of the outer circumferential cylindrical body 7 (pooled liquid W1) to efficiently enter between the internal side of the outer circumferential cylindrical body 7 and the external side of the rotating atomization head 5. In particular, as in the paint spray gun 1 in the present embodiment, if the leading end face 72 of the outer circumferential cylindrical body 7 is an annular flat face, cleaning liquid (pooled liquid W1) must be moved a long distance toward the inner side of the leading end face 72. The cleaning liquid (pooled liquid W1) that has flowed down to the leading end face 72 of the outer circumferential cylindrical body 7 can be efficiently moved inwardly by ejecting fluid from the first fluid ejection hole 731 and the second fluid ejection hole 732, respectively.

Further, the first fluid ejection hole 731 ejects fluid downwardly with respect to the axial direction, and the second fluid ejection hole 732 ejects fluid inwardly with respect to the radial direction of the axis. Thus, the cleaning liquid (pooled liquid W1) that has flowed down to the leading end face 72 of the outer circumferential cylindrical body 7 can be drawn inwardly with respect to the radial direction of the axis by the airflow of fluid ejected from the outer second fluid ejection hole 732, and can be drawn further inwardly with respect to the radial direction of the axis by the airflow of fluid ejected from the first fluid ejection hole 731. This enables the cleaning liquid to effectively enter the gap S between the internal side of the outer circumferential cylindrical body 7 and the external side of the rotating atomization head 5.

In the present embodiment, for these first fluid ejection holes 731 and second fluid ejection holes 732, fluid ejection holes that eject shaping air for regulating an area to which paint is applied during normal painting are used as is. Therefore, there is no need to separately provide fluid ejection holes that eject fluid for cleaning in the paint spray gun 1, and an additional cost for cleaning is not generated.

In the above-mentioned embodiment, to more reliably clean the paint spray gun 1, the steps of applying cleaning liquid and ejecting air are performed twice with a pause period interposed therebetween, but the steps of applying cleaning liquid and ejecting air may be performed only once.

Incidentally, for example, if the leading end face 72 of the outer circumferential cylindrical body 7 is narrow or tapered inclining toward the inner circumferential side and cleaning liquid can flow down the external face 7*b* of the outer circumferential cylindrical body 7 to fall down to the leading end portion 51 of the rotating atomization head 5, the fluid ejection step of ejecting fluid from the first fluid ejection hole 731 and the second fluid ejection hole 732 may not necessarily be performed.

EXPLANATION OF REFERENCE NUMERALS

1 paint spray gun
5 rotating atomization head
5*a* external face
7 outer circumferential cylindrical body
7*a* internal face
7*b* external face
72 leading end face
73 fluid ejection hole
731 first fluid ejection hole
732 second fluid ejection hole
W cleaning liquid
W1 pooled liquid
A1, A2 air (fluid)

The invention claimed is:

1. A method for cleaning a paint spray gun comprising a rotating atomization head that applies paint while rotating and an outer circumferential cylindrical body that covers an external side of a substantially conical part of the rotating atomization head and does not rotate, the method comprising:

a cleaning liquid application step of applying cleaning liquid toward an external face of the outer circumferential cylindrical body of the paint spray gun; and a rotating atomization head rotation step of rotating the rotating atomization head to generate a swirling flow between the outer circumferential cylindrical body and the rotating atomization head, wherein the swirling flow generated by the rotating atomization head rotation step makes the cleaning liquid, applied by the cleaning liquid application step and having flowed down the external face of the outer circumferential cylindrical body, enter between the rotating atomization head and the outer circumferential cylindrical body from the external face through a leading end face of the outer circumferential cylindrical body.

2. The method for cleaning a paint spray gun according to claim 1, wherein a rotation number of the rotating atomization head is lower than a rotation number of the rotating atomization head during normal painting.

3. The method for cleaning a paint spray gun according to claim 1, wherein the paint spray gun includes a plurality of fluid ejection holes that are configured to eject fluid, provided in the leading end face of the outer circumferential cylindrical body in a circumferential direction, the method further comprises a fluid ejection step of ejecting the fluid from the fluid ejection holes, and airflow of the fluid ejected by the fluid ejection step and the swirling flow generated by the rotating atomization head rotation step make the cleaning liquid applied by the cleaning liquid application step and having flowed down the external face of the outer circumferential cylindrical body enter between the rotating atomization head and the outer circumferential cylindrical body through the leading end face of the outer circumferential cylindrical body.

4. The method for cleaning a paint spray gun according to claim 3, wherein a rotation number of the rotating atomization head is lower than a rotation number of the rotating atomization head during normal painting.

5. The method for cleaning a paint spray gun according to claim 3, wherein an ejection pressure of the fluid ejected from the fluid ejection hole is smaller than an ejection pressure of fluid ejected from the fluid ejection hole during normal painting.

6. The method for cleaning a paint spray gun according to claim 5, wherein a rotation number of the rotating atomization head is lower than a rotation number of the rotating atomization head during normal painting.

7. The method for cleaning a paint spray gun according to claim 3, wherein the fluid ejection hole ejects fluid for regulating an area to which paint is applied during normal painting.

8. The method for cleaning a paint spray gun according to claim 7, wherein an ejection pressure of the fluid ejected from the fluid ejection hole is smaller than an ejection pressure of fluid ejected from the fluid ejection hole during normal painting.

9. The method for cleaning a paint spray gun according to claim 7, wherein a rotation number of the rotating atomization head is lower than a rotation number of the rotating atomization head during normal painting.

10. The method for cleaning a paint spray gun according to claim 3, wherein the fluid ejection holes include a plurality of first fluid ejection holes disposed on an inner side, in a radial direction of an axis, of the leading end face of the outer circumferential cylindrical body; and a plurality of second fluid ejection holes disposed on an outer side, in the radial direction of the axis, of the leading end face of the outer circumferential cylindrical body.

11. The method for cleaning a paint spray gun according to claim 10, wherein the fluid ejection hole ejects fluid for regulating an area to which paint is applied during normal painting.

12. The method for cleaning a paint spray gun according to claim 10, wherein an ejection pressure of the fluid ejected from the fluid ejection hole is smaller than an ejection pressure of fluid ejected from the fluid ejection hole during normal painting.

13. The method for cleaning a paint spray gun according to claim 10, wherein a rotation number of the rotating atomization head is lower than a rotation number of the rotating atomization head during normal painting.

14. The method for cleaning a paint spray gun according to claim 10, wherein the first fluid ejection hole ejects fluid downwardly with respect to an axial direction, and the second fluid ejection hole ejects fluid inwardly with respect to the radial direction of the axis.

15. The method for cleaning a paint spray gun according to claim 14, wherein the fluid ejection hole ejects fluid for regulating an area to which paint is applied during normal painting.

16. The method for cleaning a paint spray gun according to claim 14, wherein an ejection pressure of the fluid ejected from the fluid ejection hole is smaller than an ejection pressure of fluid ejected from the fluid ejection hole during normal painting.

17. The method for cleaning a paint spray gun according to claim 14, wherein a rotation number of the rotating atomization head is lower than a rotation number of the rotating atomization head during normal painting.

* * * * *